US005922968A

United States Patent [19]

Briscoe

[11] Patent Number: 5,922,968

[45] Date of Patent: Jul. 13, 1999

[54] BRUSH PRESSURE SYSTEM

[76] Inventor: William Anthony Briscoe, Wades House, Winchester, Hampshire, United Kingdom

[21] Appl. No.: 09/059,040

[22] Filed: Apr. 13, 1998

Related U.S. Application Data

[63] Continuation-in-part of application No. 08/822,098, Mar. 20, 1997, abandoned, which is a continuation-in-part of application No. 08/662,513, Jun. 13, 1996, abandoned.

[30] Foreign Application Priority Data

Sep. 6, 1995 [GB] United Kingdom ..... 9518230

[51] Int. Cl.[6] ..... A47L 11/16

[52] U.S. Cl. ..... 73/818; 15/49.1

[58] Field of Search ..... 73/826, 818, 819; 15/49.1

[56] References Cited

U.S. PATENT DOCUMENTS

| | | |
|---|---|---|
| 4,041,567 | 8/1977 | Burgoon . |
| 4,358,868 | 11/1982 | Cook, Jr. . |
| 4,633,541 | 1/1987 | Block . |
| 4,646,862 | 3/1987 | Meili . |
| 4,674,142 | 6/1987 | Meili . |
| 4,729,141 | 3/1988 | Berg et al. . |
| 4,910,824 | 3/1990 | Nagayama et al. . |
| 5,048,141 | 9/1991 | Huppi . |
| 5,481,776 | 1/1996 | Briscoe . |

FOREIGN PATENT DOCUMENTS

| | | |
|---|---|---|
| 0 173 394 | 3/1986 | European Pat. Off. . |
| 0 391 457 | 10/1990 | European Pat. Off. . |
| 88 05 617 | 10/1989 | Germany . |
| 94 10 119 | 11/1994 | Germany . |
| 2 054 365 | 2/1981 | United Kingdom . |
| WO 95/13737 | 5/1995 | WIPO . |

*Primary Examiner*—Max H. Noori
*Attorney, Agent, or Firm*—Young & Thompson

[57] ABSTRACT

A brush pressure control system for a cleaning, sweeping or scrubbing machine includes a machine frame (30) supporting a brush head arrangement (8, 27), an actuator arrangement (1, 10) for raising and lowering the brush head (27) mounted between the frame (30) and the brush head (27), and a resilient member operatively connected to the brush head and arranged to at least partially counterbalance the force exerted on the brush head (27) by the actuator (1, 10) when lowering the brush head (27).

33 Claims, 6 Drawing Sheets

BRUSH PRESSURE SYSTEM

This application is a continuation-in-part of U.S. Ser. No. 08/822,098 filed Mar. 20, 1997, which is a continuation-in-part of U.S. Ser. No. 08/662,513 filed Jun. 13, 1996, which are both abandoned now.

BACKGROUND OF THE INVENTION

The present invention relates to a brush pressure system for a cleaning or sweeping machine particularly such as is used for cleaning or sweeping the floor space of commercial and industrial premises or for example supermarket floors or railway station or airport concourses.

Such machines may be so-called pedestrian operated, i.e. controlled by a pedestrian operator or alternatively may be ride-on machines.

They comprise rotating brush heads and traditionally the operator is unable to choose the pressure to be applied to the floor by the brush heads: the pressure is set by the geometry of the machine in manufacture or in servicing. The applicant recently invented a control system for such machines and also a floating head system therefor and these are described in publication number WO95/13737 the subject matter of which is incorporated herein by reference.

SUMMARY OF THE INVENTION

The applicant has now developed a substantial improvement to the control system which allows it to operate more effectively, particularly over low ranges of pressures such as around and below the pressure corresponding to the weight of the brush head itself, and to provide an effective and efficient suspension system which allows for a floating head system over a wide range of pressures.

In particular, an accurate and reliable control of the pressure exerted by the brush head can readily be achieved from the range of zero pressure up to a pressure equivalent to that exerted by the weight of the brush head alone.

According to the present invention there is provided a brush pressure control system for a cleaning, sweeping or scrubbing machine comprising a machine frame supporting a brush head arrangement, an actuator arrangement for raising and lowering the brush head and mounted between the frame and the brush head, and resilient means operatively connected to the brush head and arranged to at least partially counteract the force exerted on the brush head by the actuator when lowering the brush head.

In particular, the resilient means is arranged to at least partially counterbalance the force exerted by the actuator.

The resilient means advantageously allows for accurate control of the force exerted through the brush head arrangement in the range zero to a pressure corresponding to the weight of the brush head arrangement.

Advantageously the resilience of the resilient means is selectively variable.

preferably, the resilient means comprises a cylinder and piston arrangement.

Advantageously, the resilient means comprises a gas strut arrangement.

Alternatively, or in addition, and in accordance with a particularly advantageous embodiment of the invention, the resilient means may comprise at least one spring means the spring means may be operatively connected between the frame and the brush head arrangement by means of cable means. The spring means may comprise a helical spring such as a compression spring or tension spring which may be mounted within a cylindrical spring tube.

Advantageously, the actuator arrangement comprises spring means mounted to act as suspension means including means for biasing the brush head arrangement towards a surface to be cleaned, tensioning means for tensioning the spring means so as to set the pressure of the brush head arrangement and wherein the spring means is selectively adjustable by the tensioning means over a continuous range to provide a required bias towards the surface.

Further, the system may include biasing means acting between the frame and the brush head arrangement to apply to the brush assembly a selectable bias towards the surface to be cleaned and mounted to act as suspension means between the frame and the brush head arrangement, means for monitoring and/or measuring the applied working pressure, means for displaying an indication of the measured working pressure, means for operator entry of a desired working pressure for the brush assembly and comparator means for comparing the operator input pressure to the measured pressure and for generating a control signal in response to the difference between the desired pressure and the measured pressure and means for applying the control signal to the pressure applying means.

Preferably, the system further includes measuring means for measuring the wear of a brush supported on the brush head and displaying means for displaying the measured wear on an operator console.

A load sensor may also be provided for registering when a positive pressure is applied to the brush head and means to pause the actuator when the load sensor registers such a positive pressure.

Preferably a linkage is provided between the frame and the brush head, and this may be a parallelogram linkage, to keep the brush head suitably and horizontally positioned.

According to a preferred embodiment there is also provided means for measuring the wear of the brushes of the brush head and for displaying the wear on an operator console. Such means may comprise a potentiometer registering the amount of movement of the balance beam as the actuator raises or lowers the brush head. The potentiometer registers this change as a change in electrical resistance and this is related to the brush wear. Typically brushes have a bristle length of 2 inches (4.8 cm) when new and can operate effectively even when the bristle length is worn down to only ½ inch (1.2 cm).

The preferred embodiment also provides for a control circuit which is arranged to momentarily pause the actuator at the time at which load sensors register a positive pressure on the brush head, i.e. when the brushes touch the floor. The circuitry measures the position of the potentiometer during this pause and compares it with the previously measured value stored in the circuit and/or to the value measured or preset when the brushes were new, i.e. with calibration values. Electronics such as a microprocessor then uses this information to calculate the relative wear on the brushes and to display the information on a display on the control panel of the machine, e.g. an LED display which may show brush wear as a percentage of either original or remaining bristle length, or indicate a value calculated as corresponding to the actual remaining bristle length or simply provide a high, medium or low indication. At a particularly low value the indicator can be made to flash.

These measurements and calculations may be initiated at periodic intervals during use of the machine or might be set only when the brushes are lowered from a raised position.

BRIEF DESCRIPTION OF THE DRAWINGS

For a better understanding of the present invention and to show how the same may be carried into effect, reference will now be made by way of example to the accompanying drawings in which.

DESCRIPTION OF THE PREFERRED EMBODIMENT

Figure 1:
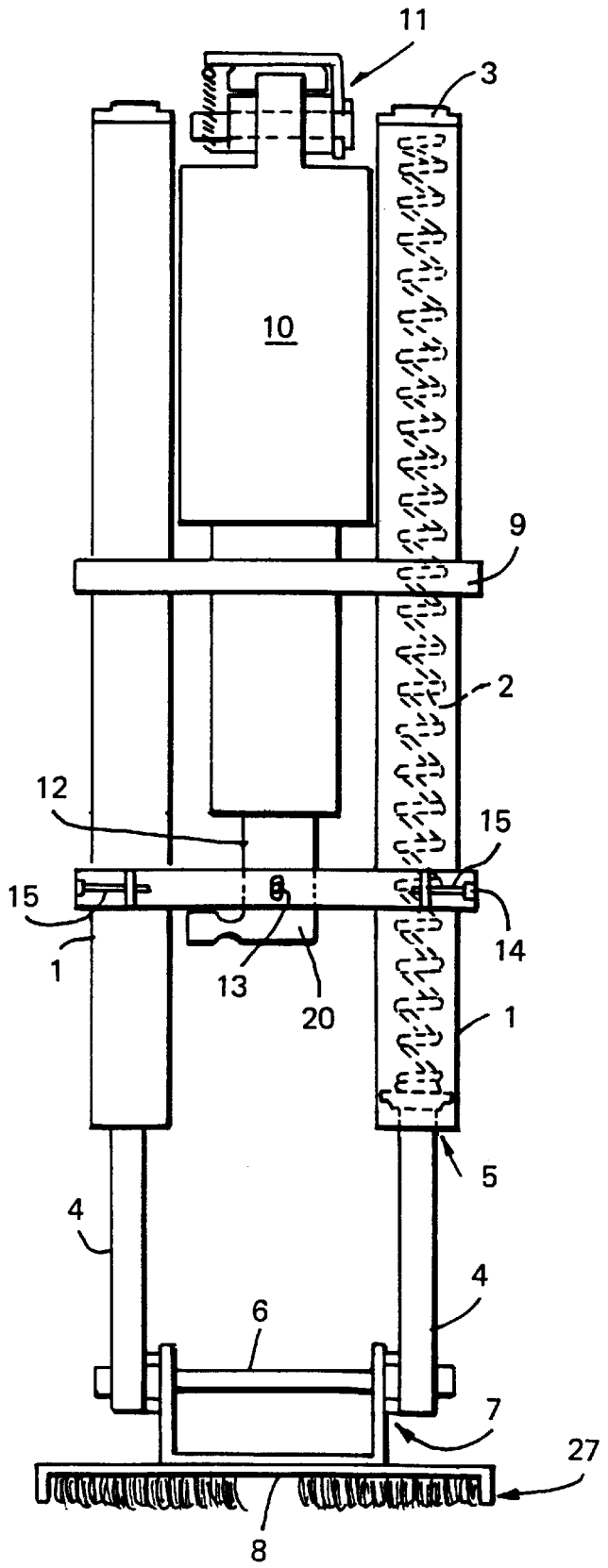
FIG. 1 shows a cross-section elevational view of a brush assembly for a cleaning and sweeping machine in front view.

In FIG. 1, the brush assembly comprises two spring tubes 1, containing springs 2. The right hand tube 1 in the Figure is shown in cut-away to illustrate spring 2. Each spring is fixed at one end to the upper end of the tubes at 3 and at the other end to a spring rod 4 which slides through an aperture 5 into the respective spring tube 1. The spring rods 4 are connected together by a bolt 6 and are fixed via assembly 7 to the brush support plate 8 to which brush head or heads 27 are connected.

The tubes 1 are prevented from rotating or skewing by a steadying plate 9. An actuator 10 is secured to a bulkhead of a cleaning machine. Actuator 10 drives actuator rod 12 which is shown in substantially closed up position in the Figure. The actuator rod 12 is fixed by a pin 13 to actuator plate 14 which is clamped to both spring tubes 1 by clamping bolts 15. Thus as the actuator drives the actuator rod 12 downwards, the spring tubes 1 move downwards and the springs 2 are compressed causing a higher pressure to be exerted on the brush head assembly whilst still providing suspension to accommodate uneven floors and brush wear. Typically, the effective spring lengths, in an uncompressed state, are around 15 inches and this is particularly suitable for a 26/32 inch brush pressure system. Such an arrangement can provide a range of 0 to 450 lb pressure in a loaded pedestrian cleaning machine fitted with apparatus according to the invention, compared to the maximum 200 lb pressure available using known apparatus. Of course other forms of biasing means could be used. A torsion spring has the advantage of taking up less vertical space in a cleaning machine. Also, a torsion spring generally has a low spring rate which is particularly suitable for this purpose. Gas struts or hydraulic or pneumatic systems could also be used.

The pressure can be further adjusted by changing the springs for different length ones or different strengths the clamping position of the spring tubes can be altered. However these changes require a service engineer.

The system is particularly adjustable since the actuator can be stopped anywhere in its stroke.

Usually brush support plate 8 will be attached to a pair of circular or elliptical brushes rotating in a plane generally parallel to the floor (or surface to be cleaned or swept or scrubbed). However, up to four brushes are in use in some cleaning machines and the apparatus of the invention could be used to control all such four brushes together or alternatively individually (in which case separate actuators would be used for each). Of course a cylindrical brush head could equally easily be controlled mounted on the brush support plate 8 or alternatively controlled at each end of its shaft by respective separate assemblies according to FIG. 1.

Figure 2:
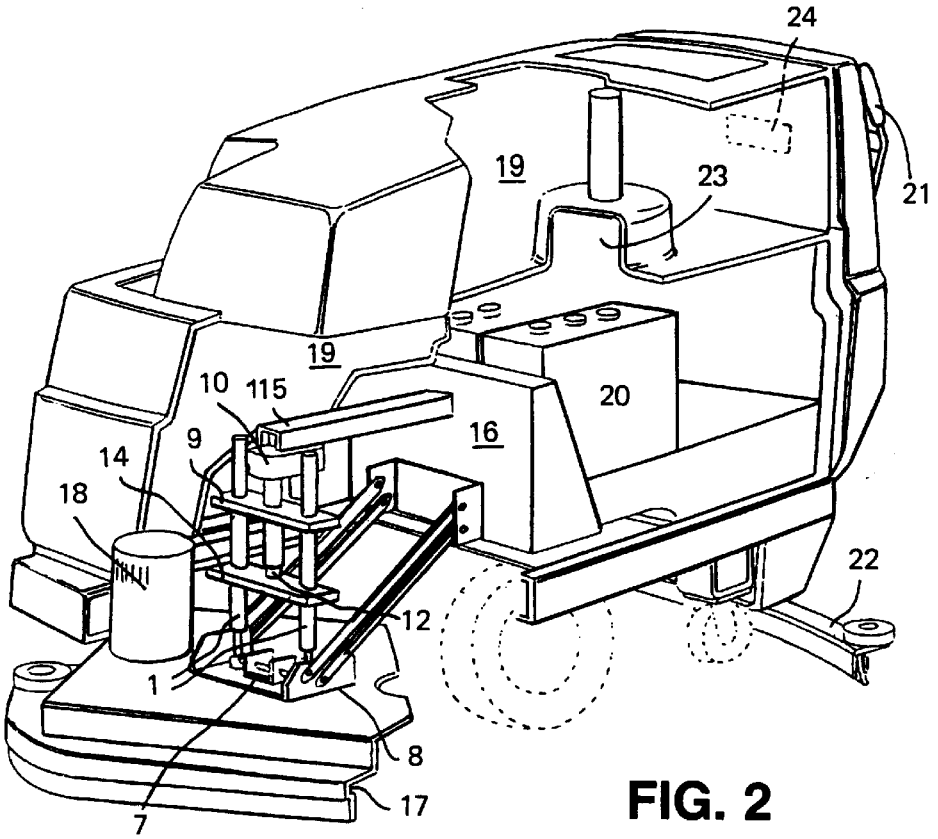
FIG. 2 is a perspective view of a cleaning and sweeping machine incorporating a brush pressure assembly according to the applicant's previous invention.

In FIG. 2 the brush assembly of FIG. 1 is shown mounted in a pedestrian cleaning apparatus. Like parts are indicated by like reference numerals and a pair of spring tubes 1 are attached to actuator rod 12 by actuator plate 14. The actuator 10 is fixed by tie bar 115 to the apparatus frame 16. A second pivoted mounting 17 connects the assembly 7 and brush support plate 8 to frame 16. The brushes themselves are not shown in FIG. 2 but are mounted below the support plate 8 behind the protective flange 17 and are driven by scrub brush motors 18 (one of which is shown in FIG. 2).

FIG. 2 also illustrates the relative positions of water tank or tanks 19, a battery pack 20 for driving the scrub motors 18 together with the transverse drive of the cleaning apparatus. The direction of transverse drive is controlled by a handle 21. A squeegee 22 has suction applied via vacuum motor 23.

Additionally a brush head pressure control panel 24 is provided within the operator's view.

Figure 3:
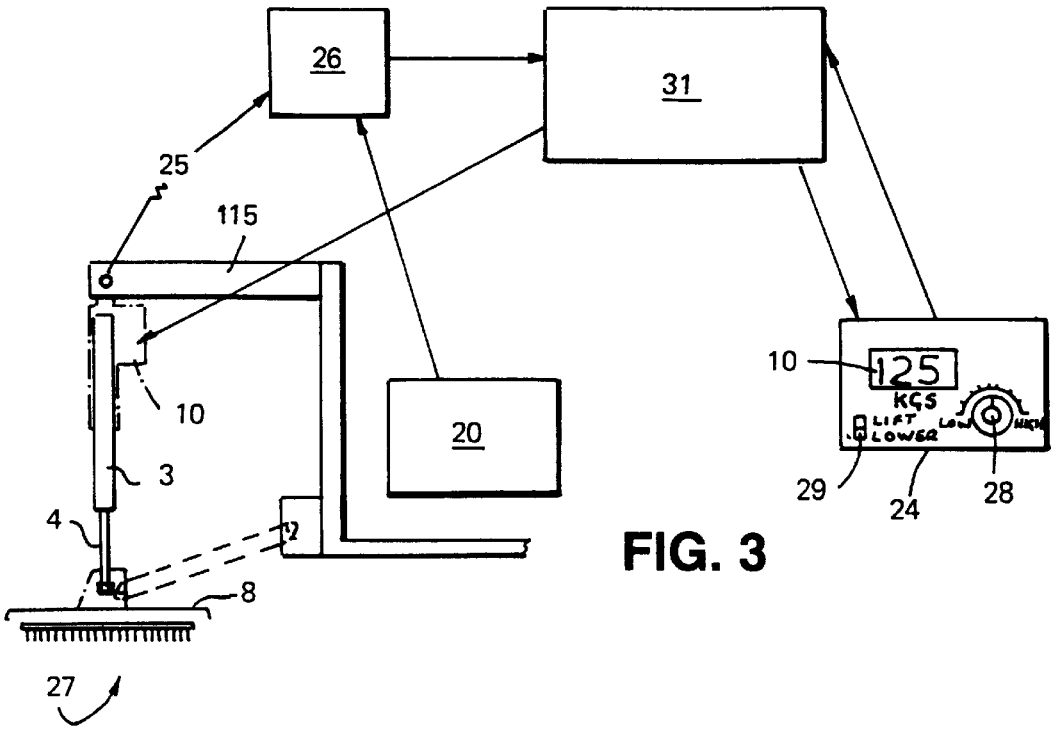
FIG. 3 is a diagrammatic representation of a control for the apparatus of FIGS. 1 and 2.

In FIG. 3 the brush assembly is shown schematically in side view and the control system is illustrated as a block diagram.

The position of the brush head 27 relative to the floor to be cleaned, is controlled by electric or hydraulic actuator 10 lifting or lowering the brush head via an actuator rod which compresses springs in spring tube 1. Other resilient means such as a gas strut may be used for applying pressure to the brush head against the floor and of course other means may be used to control the position of the brush head such as hydraulic or pneumatic means.

A pressure sensor is located within the actuator 10. In use this sensor monitors the pressure applied by the brush to the floor and generates a signal 25. The pressure sensor may comprise a strain gauge on the actuator plate 14 shown in FIG. 1, or a piezoelectric sensor or position sensor. Alternatively a securing pin 11 (see FIG. 1) which connects the assembly to the apparatus frame, may be used as a shear gauge to measure pressure. An amplifier 26 converts this pressure signal 25 to a value usable in the subsequent circuitry.

The control panel 24 is provided within sight of an operator. It has a pressure select knob 28 by which the operator can pre-select a particular pressure. A rocker switch 29 lifts or lowers the brush head 27 relative to the floor depending on the switch position. A digital display 24' illustrates the pressure of the brush head 27 on the floor, as measured by the pressure sensor.

A processor 26' compares the measured pressure signal with the operator selected pressure and generates a control signal accordingly to control (as necessary) the actuator 10 to make the measured pressure substantially the same as the selected pressure.

This processor 26' may be of simple construction such as comprising an electronic comparator and amplifier circuit, or it may comprise a standard CPU unit in chip form.

Power for the electronic components is supplied by the on-board battery 20 or by alternative low power battery sources.

Figure 4:
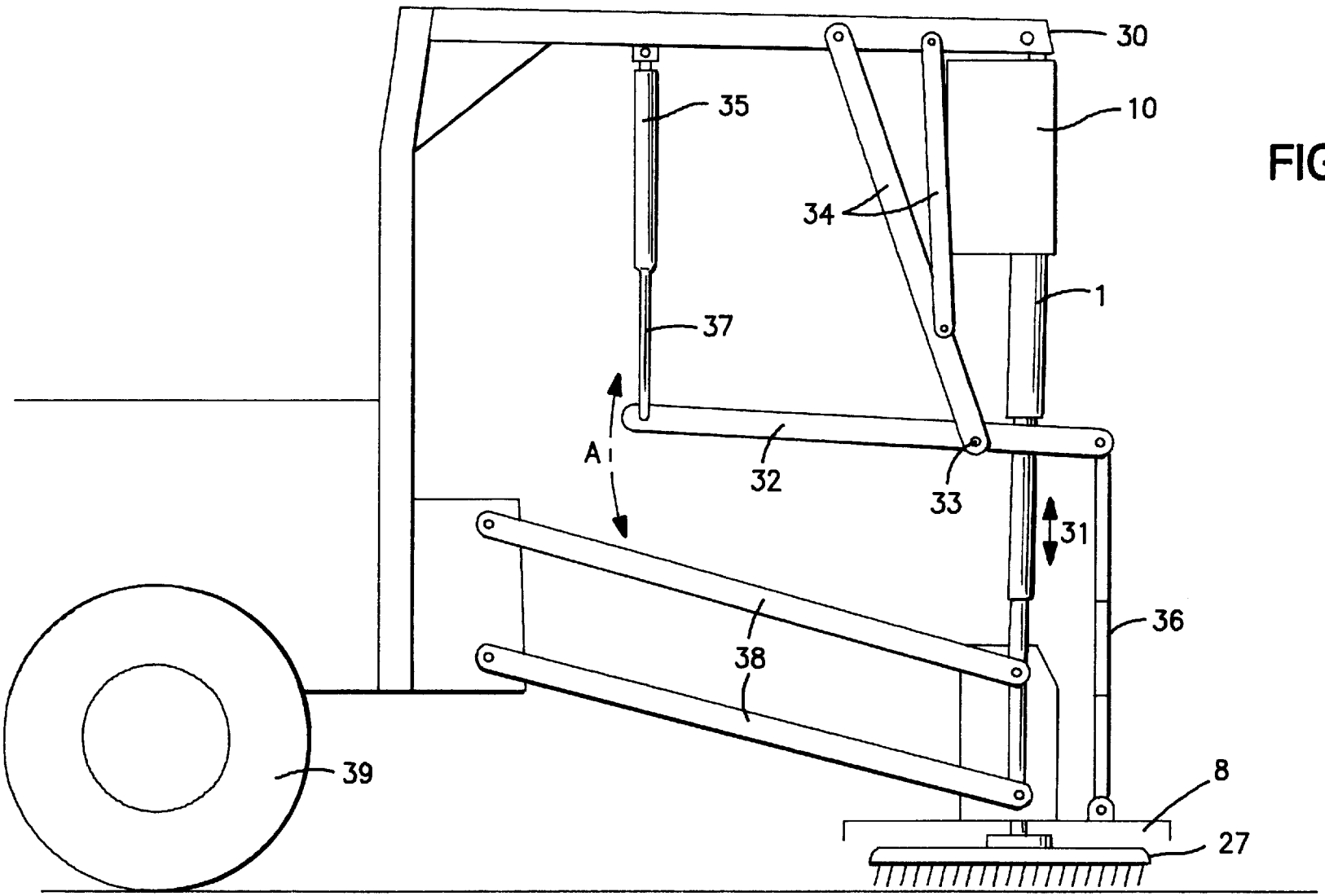
FIG. 4 is a side view of the brush pressure assembly of FIG. 1 showing the control system of the present invention.

FIG. 4 shows the brush head with planetary brushes for scrubbing, cleaning, polishing or sweeping a floor surface mounted via the actuator 10 (only one arm of which is shown) to the machine frame 30, and specifically to an actuator support bracket.

The brush head is raised and lowered as indicated by arrow 31 by a screw jack-mounted on the actuator 10.

The motors for driving the brushes are mounted on the brush head but are not shown in FIG. 3. The water tanks for the machine, mounted on the frame, or chassis are also omitted in FIG. 3 to more clearly show the other parts of the device.

A balance beam 32 is mounted by pivot bearing 33 to one end of a pivot support 34, the other end of which is connected to the frame. The beam 32 is also connected to actuator arm 1 and on the other side of the pivot bearing 33 to a counterbalance means in the form of a gas strut 35, 37 to counterbalance the weight of the brush head. The opposite end of beam 32 is linked to the brush head by a turnbuckle linkage adjuster 36, which is used to adjust the counterbalance for brushes of different length, for example to prevent jamming of the brushes against the floor.

A potentiometer for measuring brush wear is connected between the balance beam 32 and the pivot support 34.

Further support for the brush head is provided by a parallelogram linkage 38 between the brush head and the side of the main frame to keep the brush deck positioned.

A drive wheel 39 for the machine is shown: usually one such wheel is positioned at each corner of the chassis or frame.

The path of movement of the counterweight is shown by arrow A, as the brushes are raised by the lower line and as they are lowered by the upper line. As the brushes are lowered to the floor by the actuator 10 the balance beam 32 rotates about pivot bearing 33 serving to compress the gas strut arrangement 35, 37. The brush head 8 is lowered to the floor by the extension of the actuator 1. However as the brush head 8 approaches the floor, the pressure to be exerted by the brush head 8 on the floor is advantageously counterbalanced by the gas strut means 35, 37. This counterbalancing action is achieved by the compression of the gas strut arrangement 35, 37 which, having a sealed volume within the chamber 35, limits the degree to which the piston member 37 is slidable within the chamber 35 and, advantageously, in a resilient manner. Thus, the relative movement between the piston member 37 and the chamber 35 advantageously allows for the exertion of an accurately determinable low pressure at the brush head 8 since the limiting, and thus counterbalancing, effect of the gas strut arrangement 35, 37 serves to effectively reduce the pressure applied by way of the actuator 1, and through the brush head 8, to the floor.

When the force exerted by the actuator 1 on the brush head 8 is removed, i.e. the actuator 1 is retracted so as to raise the brush head 8, the compressed pressure within the chamber 35 is relieved and the gas strut arrangement 35, 37 extends and the volume of fluid introduced into the chamber 35 is chosen such that the extended gas strut arrangement 35, 37 can readily support the brush head 8 in such a raised position.

It will be appreciated that, by acting as a counterbalancing force, the gas strut arrangement 35, 37 serves to offer support for the weight of the brush head 8 and allows the net force exerted by way of the actuator 1 through the brush head 8 onto the floor to be accurately controlled particularly in the range of zero pressure to pressure corresponding to the weight of the brush head arrangement 8.

Also, the change in position of the balance beam 32 causes a corresponding change in the position of the wiper of the potentiometer and 37 thus the measured resistance changes. A load sensor (not shown in FIG. 4) detects the position at which the brushes touch the floor, i.e. a positive pressure is registered and pauses the actuator momentarily for the potentiometer measurement at that position to be recorded. The actuator then continues to drive the brush head down onto the floor until the desired pressure on the floor is attained.

The counterbalance means 35, 37 counteracts the weight of the brush head and allows a very low range of brush pressures to be selected, much lower than was hitherto attainable, for example less than 100 lbs/in$^2$. This range is used for light cleaning or polishing or for cleaning fragile or specialist floor surfaces.

Figure 5:
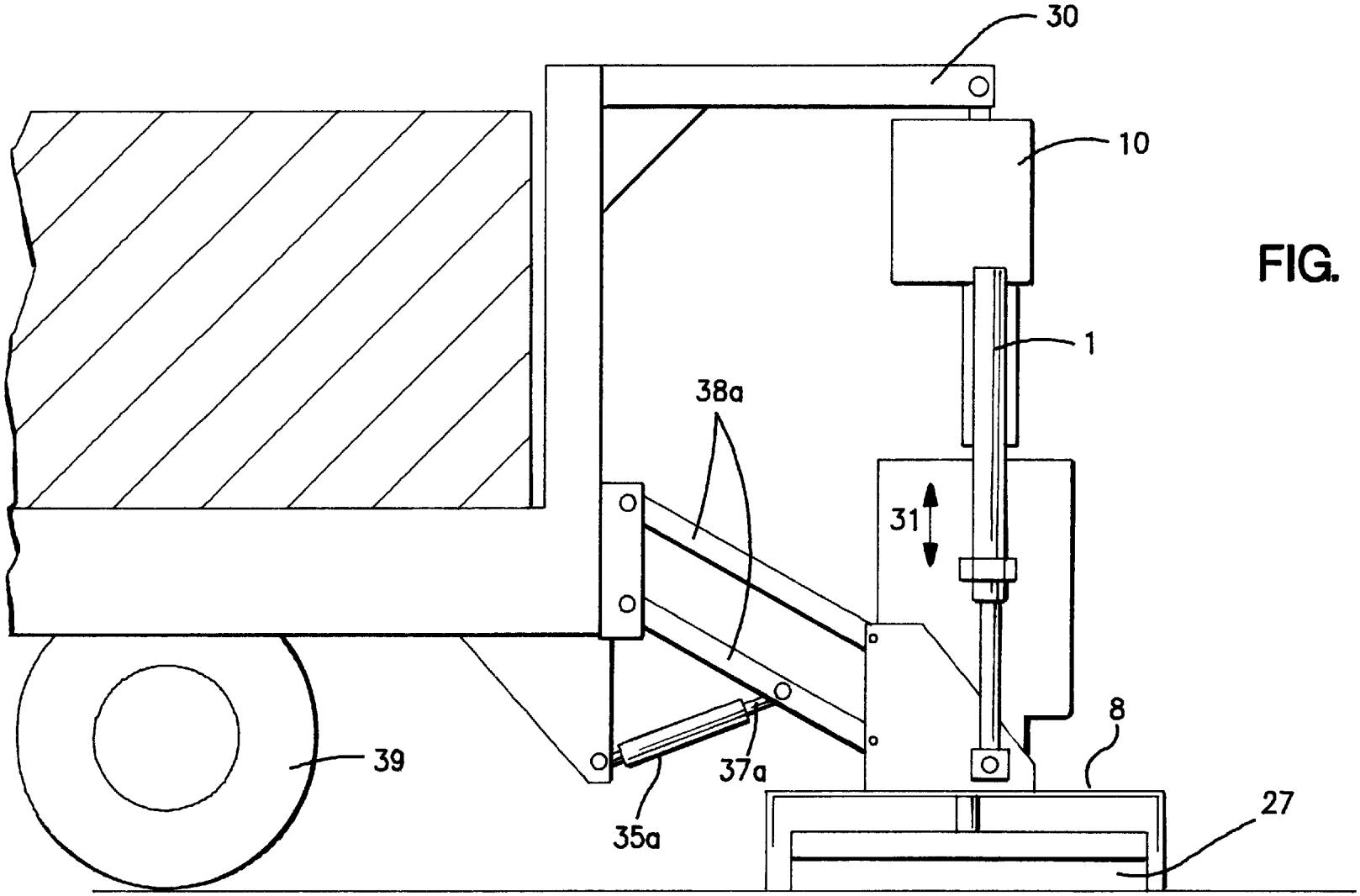
FIG. 5 is a side view of a brush pressure assembly according to another embodiment of the invention.

FIG. 5 is a side view of another embodiment of the present invention in which the features common to FIG. 4 are provided with the same reference numerals.

The counterbalance arrangement illustrated in FIG. 5 operates in a similar manner to that illustrated with reference to FIG. 4 in that, as the brush head 8 is lowered towards the floor by means of the actuator 1, the gas strut arrangement 35*a*, 37*a* is compressed.

As will be appreciated from FIG. 5, the device includes a shorter parallelogram arrangement 38*a* and found in FIG. 4, and the gas strut arrangement 35*a*, 37*a* is operatively connected between a frame portion of the sweeping/cleaning machine and the brush head 8 by means of its connection to the lower strut of the parallelogram arrangement 38*a*. As will be appreciated, as the brush head 8 is moved towards contact with the floor surface to be swept or cleaned, the parallelogram arrangement 38*a* pivots in a clockwise manner serving to move the piston member 37*a* into the chamber 35*a* of the gas strut arrangement and which relative movement is gradually resisted by the pressure developed within the chamber 35*a*. The counterbalancing force offered by the gas strut arrangement 35*a*, 37*a* shown in FIG. 5 serves, as with the arrangement illustrated in FIG. 4, to provide a net force at the brush head 8 which can readily be controlled particularly in the range zero pressure to a pressure corresponding to the weight of the brush head 8.

Figure 6:
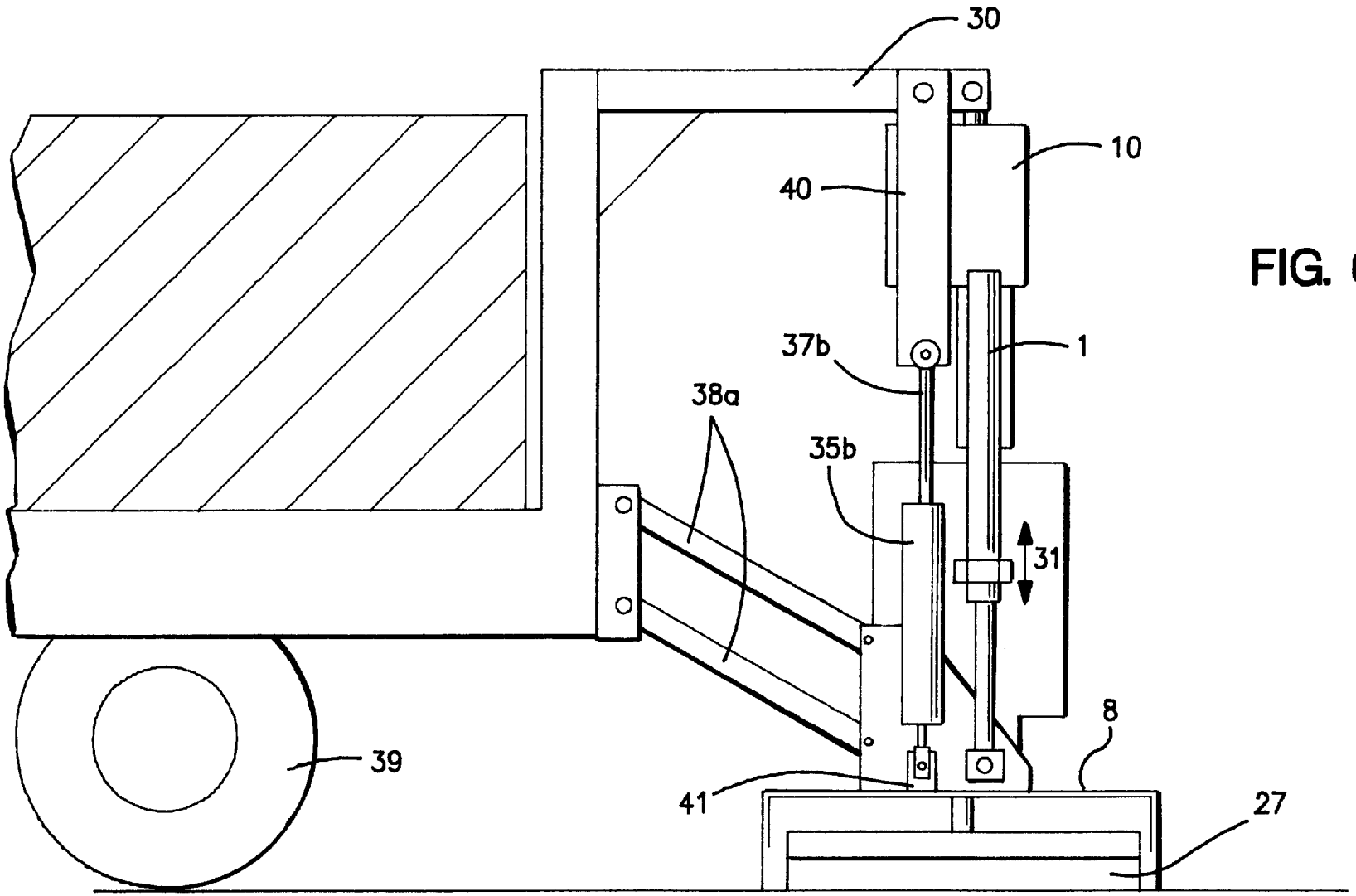
FIG. 6 is a side view of a brush pressure assembly according to yet another embodiment of the present invention.

Turning now to FIG. 6, yet another embodiment of the present invention is illustrated and in which the features common to FIGS. 4 and 5 have been given similar reference numerals.

The main difference between the embodiment of FIG. 6 and the embodiments of FIGS. 4 and 5 is that the required net force exerted by the brushes 27 of the brush head arrangement 8 on the ground is achieved when the gas strut arrangement 35*b*, 37*b* is extended rather than compressed. Again, it is the pressure within the chamber 35*b* that limits the extent to which the piston member 37*b* can be extended therefrom and this serves to counterbalance the force exerted by way of the actuator 1. The gas strut arrangement 35*b*, 37*b* of the embodiment of FIG. 6 is operatively connected between an extension bracket 40 of the frame 30 of the cleaning machine and a connection lug 41 of the brush head arrangement 8. As will be appreciated from FIG. 6, as the actuator is operated so as to lower the brush head arrangement towards the ground to be swept/cleaned, the gas strut arrangement 35*b*, 37*b* is extended and effectively becomes tensioned in view of the pressure developed within the chamber 35*b*. In reverse when the brush head arrangement 8 is raised from the floor, the pressure developed within the chamber 35*b* by the previous relative movement between the chamber 35*b* and the piston member 37*b* serves to assist with supporting the weight of the brush head arrangement 8 clear of the floor.

As with each of the embodiments described herein, the gas strut arrangement can advantageously be provided in a manner such that the pressure within the chamber thereof can be selectively varied to any particular value when the brush pressure arrangement is at rest, i.e when the brush head arrangement 8 is raised from the floor.

Figure 7:
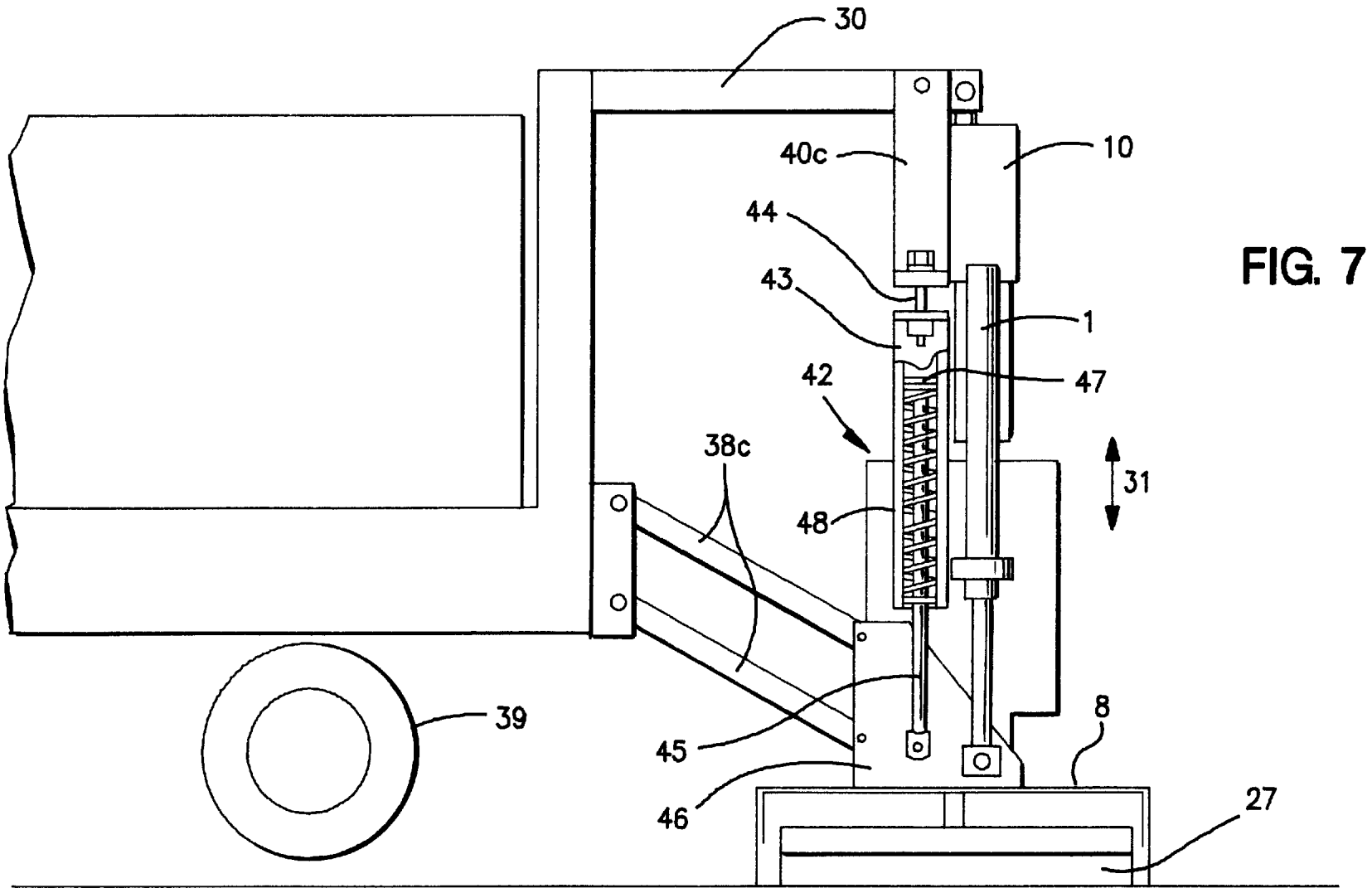
FIG. 7 is a side view of a brush pressure assembly according to a further embodiment of the present invention.

The embodiment of the present invention as illustrated in FIG. 7 is similar to that illustrated with reference to FIGS. 5 and 6 with the exception that a compression spring arrangement 42 is employed as the resilient means.

As can be seen, the embodiment of FIG. 7 is illustrated by reference to a floor sweeping/cleaning machine which also employs a support frame 30 having an actuator 10 depending therefrom which serves to lift, or lower, the brush head arrangement 27 by means of a pair of spring tubes 1.

The floor sweeping/cleaning machine is arranged to be moved over the surface to be swept/cleaned by way of a plurality of wheels 39.

As with the embodiments shown in FIGS. 4 and 5, a parallelogram connection arrangement 38*c* also serves to connect the brush head arrangement 27 to the support frame 30 of the sweeping/cleaning machine. The resilient means is operatively connected between the support frame 30 and a mounting bracket 46 extending upwardly from the brush head arrangement 27.

A mounting plate 40*c* depends downwardly from the support frame 30. The lower region of the mounting plate 40*c* has a horizontally extending lug which presents an aperture through which an adjustment bolt 44 extends. The adjustment bolt 44 likewise extends into one end of a cylinder 43 which houses a shaft/piston 45, 47 arrangement slidably mounted therein. The shaft 45 extends out from the cylinder 43 at its end opposite the end at which the adjustment bolt 44 is mounted. The adjustment bolt 44 not only serves to connect the mounting plate 40*c* to the cylinder 43, but also allows for adjustment of the separation between the mounting plate 40*c* and the cylinder 43 so as to effect an adjustment in the tension arising in the resilient member.

In this embodiment, the resilient member comprises a compression spring 48 mounted within the cylinder 43 and at a position beneath the piston 47 as shown in FIG. 7 so that, as the piston 47 moves downwardly within the cylinder 43, it serves to compress the spring 48.

The lower end of the shaft 45 is secured to a mounting bracket 46 which extends upwardly from the brush support plate 8 and to the parallelogram linkage 38*c*.

The compression spring 48 therefore serves to resist downward movement of the piston 47 which, through its connection to the brush support plate 8 by means of the shaft 45 and mounting bracket 46, corresponds to downward movement of the brush head arrangement 27.

From a consideration of the previous embodiments discussed, it will therefore be appreciated that the compression spring 48 readily serves to counteract the force exerted through the actuator in a direction so as to achieve operation of the brush head arrangement 27 at the required low pressures.

With all embodiments of the present invention, comparison of readings on the potentiometer as the brushes contact the floor is a measure of the amount of wear on the brushes and can be used to provide an indication of such on a display panel of the operator's console.

This example is of course only one of many possible embodiments of the invention. It will readily be understood by a person skilled in the art that this system is applicable to cleaning, sweeping, polishing and scrubbing machines of a wide variety of types and could be used on machines needing to apply pressure not only downwards but upwards, and sidewards too with suitable modifications which are within the non-inventive capabilities of a person skilled in the art.

It should be appreciated that the counterbalancing means of the present invention can be provided by any appropriate structure that affords the appropriate resilience and offers the appropriate counterbalancing forces and such requirements can readily be achieved by way of spring means of any appropriate form, strength and number.

Further, embodiments can readily be provided in which spring means such as the spring (48) and tube (43) of FIG. 7 are employed in place of the gas struts (35, 35*a*, 35*b*) shown in FIGS. 4, 5 and 6.

I claim:

1. A brush pressure control system for a cleaning, sweeping, scrubbing or burnishing machine comprising a machine frame supporting a brush head assembly supporting at least one rotatable brush for contacting a surface to be cleaned, swept, scrubbed or burnished, an actuator, mounted between the frame and the brush head assembly, for raising and lowering the brush head and having spring means mounted to act as suspension means and including means for biasing the brush head assembly towards the surface, tensioning means for tensioning the spring means so as to set the pressure of the brush head assembly and wherein the spring means is selectively adjustable by the tensioning means over a continuous range to provide a required bias towards the surface, and means operatively connected to the brush head assembly and arranged to at least partially counteract the force exerted on the brush head assembly by the actuator when lowering the brush head assembly and so as to control the pressure exerted by the brush head assembly on the surface to a range from zero pressure to a pressure corresponding to the weight of the brush head assembly.

2. The system according to claim 1, wherein the means seperatively connected to the brush head assembly comprises resilient means.

3. The control system according to claim 2, wherein the resilience of the resilient means is selectively variable.

4. The control system according to claim 2, wherein the resilient means comprises at least two relatively movable members and arranged to be relatively movable in a resilient manner.

5. The control system according to claim 4, wherein one of the movable members is slidable within a chamber portion formed by the other of the movable members.

6. The control system according to claim 5, wherein the resilience is due to the pressure arising within the chamber.

7. The control system according to claim 6, wherein the pressure value can be selectively determined.

8. The control system according to claim 6, wherein the pressure is achieved by the introduction of a predetermined volume of fluid into the chamber.

9. The control system according to claim 6, wherein gas is provided within the chamber and the resilient means comprises a gas strut arrangement.

10. The control system according to claim 2, wherein the resilient means comprises a cylinder and piston arrangement.

11. The control system according to claim 2, wherein the resilient means is arranged to be compressed as the brush head arrangement is lowered.

12. The control system according to claim 2, wherein the resilient means is arranged to be extended as the brush head arrangement is lowered.

13. The control system according to claim 2, wherein the resilient means is located adjacent, and aligned with, the actuator arrangement.

14. The control system according to claim 2, wherein the resilient means comprises at least one spring means.

15. The control system according to claim 14, wherein the spring means comprises a helical spring.

16. A control system according to claim 15, wherein the spring means comprises a compression spring.

17. A control system according to claim 15, wherein the spring means is arranged to act along a line parallel to the longitudinal axis of the actuator.

18. The control system according to claim 14, wherein the spring means is operatively connected between the frame and the brush head arrangement by means of cable means.

19. The control system according to claim 14, wherein the spring comprises a wound leaf spring.

20. The control system according to claim 1, wherein the means operatively connected to the brush head assembly comprises an elongate balance beam pivotally connected to the frame and connected at one end to the actuator for movement therewith, and at the other end having a counterbalance mass mounted thereon.

21. The control system according to claim 20, wherein said counterbalance is of substantially equivalent mass to the mass of the brush head.

22. The control system according to claim 20, further comprising a linkage connecting said frame and said brush head in such a manner that the brush head is substantially horizontally supported.

23. The control system according to claim 1, wherein said tensioning means include means for controlling the tension in said spring means so as to vary the bias of said brush head assembly.

24. The control system according to claim 23, wherein said means for controlling the tension comprise an actuator arranged to compress said spring means.

25. The control system according to claim 24, wherein said actuator is hydraulically drivable.

26. The control system according to claim 24, wherein the spring means include two spring tubes and two springs, each spring being mounted in a respective spring tube, and wherein said actuator is arranged for compressing said two springs simultaneously.

27. The control system according to claim 1, wherein the spring means include at least one spring tube and at least one spring mounted in said at least one spring tube.

28. The control system according to claim 1 and including means for monitoring or measuring the applied working pressure, means for displaying an indication of the measured working pressure, means for operator entry of a desired working pressure for the brush head assembly and comparator means for comparing the operator input pressure to the measured pressure and for generating a control signal in response to the difference between the desired pressure and the measured pressure and means for applying the control signal to the pressure applying means.

29. The control system according to claim 28, wherein the comparator is comprised of an electronic processor.

30. The control system according to claim 1, further comprising measuring means for measuring the wear of a brush supported on the brush head and displaying means for displaying the measured wear on an operator console.

31. The control system according to claim 30, wherein the measuring means comprises a potentiometer for sensing the amount of movement of the balance beam as the actuator is used to raise or lower the brush head arrangement.

32. The control system according to claim 1, further comprising a load sensor for registering when a positive pressure is applied to the brush head and means to pause the actuator when the load sensor registers such a positive pressure.

33. The control system according to claim 1, comprising means to calculate the relative wear on the brushes and means to display the relative wear.

* * * * *